US010334950B2

(12) United States Patent
Chen et al.

(10) Patent No.: US 10,334,950 B2
(45) Date of Patent: Jul. 2, 2019

(54) SLIDE RAIL ASSEMBLY

(71) Applicants: KING SLIDE WORKS CO., LTD., Kaohsiung (TW); KING SLIDE TECHNOLOGY CO.,LTD., Kaohsiung (TW)

(72) Inventors: Ken-Ching Chen, Kaohsiung (TW); Shun-Ho Yang, Kaohsiung (TW); Kai-Wen Yu, Kaohsiung (TW); Chun-Chiang Wang, Kaohsiung (TW)

(73) Assignees: KING SLIDE WORKS CO., LTD., Kaohsiung (TW); KING SLIDE TECHNOLOGY CO., LTD., Kaohsiung (TW)

( * ) Notice: Subject to any disclaimer, the term of this patent is extended or adjusted under 35 U.S.C. 154(b) by 8 days.

(21) Appl. No.: 15/821,836

(22) Filed: Nov. 23, 2017

(65) Prior Publication Data

US 2018/0317652 A1 Nov. 8, 2018

(30) Foreign Application Priority Data

May 4, 2017 (TW) ..... 106115073 A

(51) Int. Cl.

| | |
|---|---|
| ***A47B 88/40*** | (2017.01) |
| ***A47B 88/423*** | (2017.01) |
| ***A47B 88/443*** | (2017.01) |
| ***A47B 88/49*** | (2017.01) |
| ***A47B 88/407*** | (2017.01) |

(52) U.S. Cl.

CPC ..... *A47B 88/423* (2017.01); *A47B 88/407* (2017.01); *A47B 88/443* (2017.01); *A47B 88/49* (2017.01); *A47B 2088/4235* (2017.01)

(58) Field of Classification Search

CPC ..... A47B 88/49; A47B 88/407; A47B 88/423; A47B 88/443

USPC ..... 312/334.44, 334.6, 334.47, 333, 334.8, 312/334.1, 334.4

See application file for complete search history.

(56) References Cited

U.S. PATENT DOCUMENTS

| | | | | |
|---|---|---|---|---|
| 4,872,734 | A | 10/1989 | Rechberg | |
| 6,244,678 | B1 * | 6/2001 | Dopp | A47B 88/467 312/333 |
| 6,851,773 | B2 * | 2/2005 | Chen | A47B 88/493 312/333 |
| 7,520,577 | B2 * | 4/2009 | Chen | A47B 88/493 312/333 |
| 8,303,052 | B2 * | 11/2012 | Chen | A47B 88/493 312/319.1 |
| 9,279,280 | B1 | 3/2016 | Chen | |
| 9,675,175 | B1 | 6/2017 | Chen | |
| 2008/0246378 | A1 * | 10/2008 | Chen | A47B 88/57 312/334.46 |

(Continued)

FOREIGN PATENT DOCUMENTS

| | | |
|---|---|---|
| EP | 3 041 328 A1 | 7/2016 |
| JP | S63-51928 U | 4/1988 |

(Continued)

*Primary Examiner* — James O Hansen

(74) *Attorney, Agent, or Firm* — Winston Hsu

(57) ABSTRACT

A slide rail assembly includes a first rail, a second rail and a third rail. The second rail is movably mounted between the first rail and the third rail. The second rail and the third rail are movable relative to the first rail. The second rail and the third rail are detachable from the first rail.

17 Claims, 14 Drawing Sheets

(56) References Cited

U.S. PATENT DOCUMENTS

2013/0016928 A1 1/2013 Chen

FOREIGN PATENT DOCUMENTS

JP 2000-236970 A 9/2000
JP 2017-56178 A 3/2017

* cited by examiner

SLIDE RAIL ASSEMBLY

BACKGROUND OF THE INVENTION

1. Field of the Invention

The present invention relates to a slide rail assembly, and more particularly, to a slide rail assembly having two rails detachable from another rail.

2. Description of the Prior Art

Generally, a slide rail assembly usually comprises a first rail, a second rail and a third rail. Wherein, the second rail is movably mounted between the first rail and the third rail. In current technology, the third rail is configured to carry an object. Thus, only the third rail can be detached from the other two rails (that is, the first rail and the second rail), in order to allow a user to perform maintenance on the object (or the third rail). However, according to the current technology, such slide rail assembly cannot meet specific market requirements.

SUMMARY OF THE INVENTION

The present invention relates to a slide rail assembly having two rails detachable from another rail.

According to an embodiment of the present invention, a slide rail assembly comprises a first rail, a second rail and a third rail. The first rail is arranged with a first blocking feature. The second rail is arranged with a second blocking feature and movable relative to the first rail. The third rail is movable relative to the second rail. Wherein, the second rail is movably mounted between the first rail and the third rail. Wherein, when the second rail is moved relative to the first rail along a first direction to a first open position, the second blocking feature is blocked by the first blocking feature in order to prevent the second rail from being moved from the first open position along the first direction. Wherein, one of the first blocking feature and the second blocking feature is configured to be operated to move away from each other with the second blocking feature being no longer blocked by the first blocking feature, in order to allow the second rail to be moved from the first open position along the first direction to be further detached from the first rail.

Preferably, the slide rail assembly further comprises an operating member configured to be operated to drive the second blocking feature to move.

Preferably, the second rail comprises a through hole facing the first rail, and the second blocking feature passes through the through hole.

Preferably, the slide rail assembly further comprises a third blocking feature and a fourth blocking feature respectively arranged on the second rail and the third rail. When the third rail is moved relative to the second rail along the first direction to a second open position, the fourth blocking feature is blocked by the third blocking feature in order to prevent the third rail from being moved from the second open position along the first direction.

Preferably, one of the third blocking feature and the fourth blocking feature is configured to be operated to move away from each other with the fourth blocking feature being no longer blocked by the third blocking feature, in order to allow the third rail to be moved from the second open position along the first direction to be further detached from the second rail.

Preferably, the fourth blocking feature is operatively connected to the third rail.

Preferably, the slide rail assembly further comprises a fifth blocking feature operatively connected to the third rail. When the third rail is located at the second open position relative to the second rail, the fourth blocking feature and the fifth blocking feature are respectively located at two opposite sides of the third blocking feature.

Preferably, the slide rail assembly further comprises an engaging member mounted to the second rail. When the third rail is moved relative to the second rail along the first direction from a retracted position to a first predetermined position, the engaging member is configured to engage with the third rail in order to allow the second rail and the third rail to be synchronously moved relative to the first rail along the first direction.

Preferably, the first rail comprises a releasing feature. When the second rail and the third rail are synchronously moved relative to the first rail along the first direction to a second predetermined position, the releasing feature is configured to disengage the engaging member from the third rail, in order to allow the third rail to be moved relative to the second rail along the first direction.

Preferably, the engaging member is pivoted to the second rail. The slide rail assembly further comprises an elastic member configured to provide an elastic force to the engaging member. The third rail comprises a first wall, a second wall and a side wall connected between the first wall and the second wall. When the third rail is located at the retracted position relative to the second rail, the engaging member is driven to abut against the first wall and held in a first state by the elastic force of the elastic member.

Preferably, the third rail has an opening and a rail wall adjacent to the opening. The engaging member comprises an engaging part. When the third rail is located at the first predetermined position relative to the second rail, the engaging member is rotated relative to the second rail from the first state to a second state in response to the elastic force of the elastic member, such that the engaging part enters the opening to be located at a position corresponding to the rail wall.

Preferably, the second rail comprises an aperture facing the first rail. The engaging member comprises an extension part passing through the aperture. The releasing feature comprises a first guiding part. During a process of the second rail and the third rail being synchronously moved to the second predetermined position along the first direction, the extension part of the engaging member is guided by the first guiding part to disengage the engaging member from the third rail.

Preferably, the releasing feature further comprises a blocking part. When the second rail is moved relative to the first rail from the first open position to a third predetermined position along a second direction opposite to the first direction, the extension part of the engaging member is blocked by the blocking part for preventing the second rail from being moved relative to the first rail along the second direction.

Preferably, the releasing feature further comprises a second guiding part. During a process of the second rail being moved relative to the first rail from the first open position to the third predetermined position along the second direction, the engaging member is guided by the second guiding part through the extension part.

Preferably, during a process of the third rail being moved relative to the second rail along the second direction, the engaging member is driven by the third rail to move, such that the extension part of the engaging member is no longer blocked by the blocking part.

Preferably, the releasing feature further comprises a linear part. The blocking part and the linear part are located between the first guiding part and the second guiding part.

According to another embodiment of the present invention, a slide rail assembly comprises a first rail, a second rail and a third rail. The first rail is configured to be mounted to a first object. The third rail is configured to carry a second object. Wherein, the second rail is movably mounted between the first rail and the third rail. Wherein, the second rail is detachable from the first rail along a first direction.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
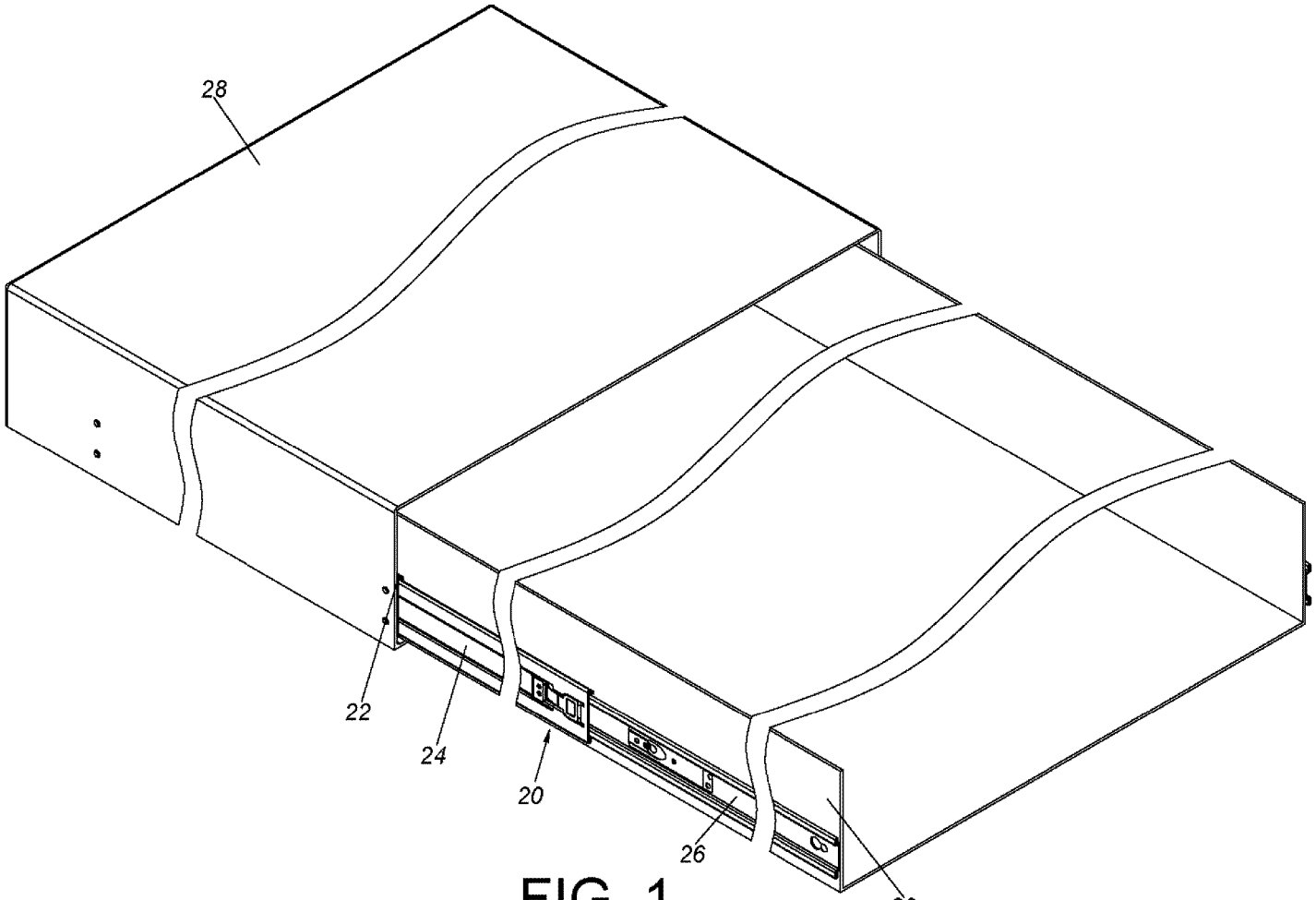
FIG. 1 is a diagram showing a slide rail assembly applicable to two objects according to an embodiment of the present invention.

FIG. 1 is a diagram showing a slide rail assembly 20 comprising a first rail 22, a second rail 24 and a third rail 26 according to an embodiment of the present invention. Wherein, the second rail 24 is movably mounted between the first rail 22 and the third rail 26. According to an embodiment, the first rail 22 is configured to be mounted to a first object 28; and the third rail 26 is configured to carry a second object 30. Wherein, the first object 28 can be a first chassis (or a first housing), and the second object 30 can be a second chassis (or a second housing). Alternatively, the first object 28 can be a cabinet, and the second object 30 can be a drawer. But the present invention is not limited thereto. According to such arrangement, since the third rail 26 is movable relative to the first rail 22 and/or the second rail 24, the second object 30 can be pulled out of the first object 28, or can be pushed into the first object 28.

Figure 2:
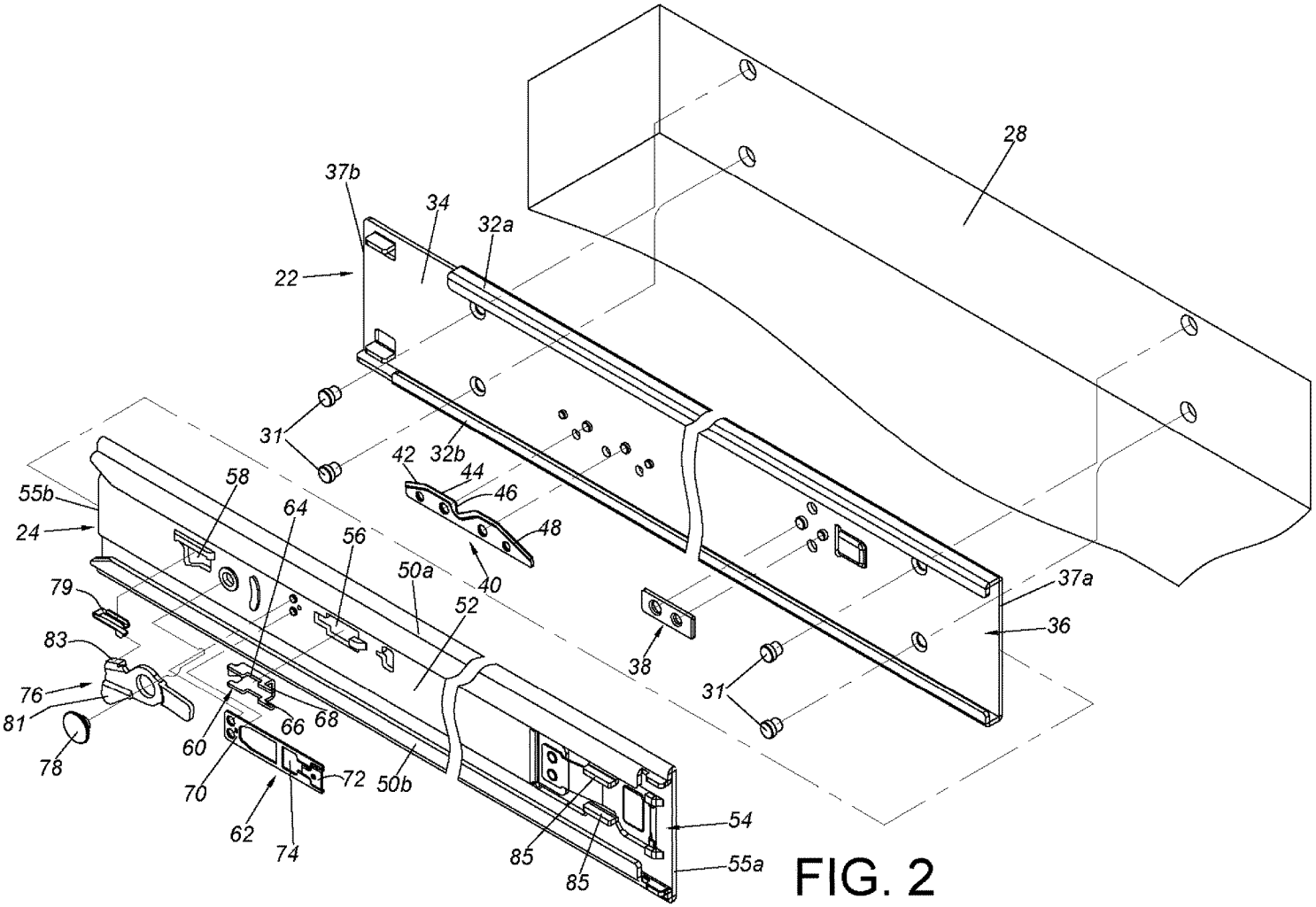
FIG. 2 is an exploded view of the slide rail assembly comprising a first rail and a second rail according to an embodiment of the present invention, wherein the first rail is configured to be mounted to a first object.
Figures 3, 4:
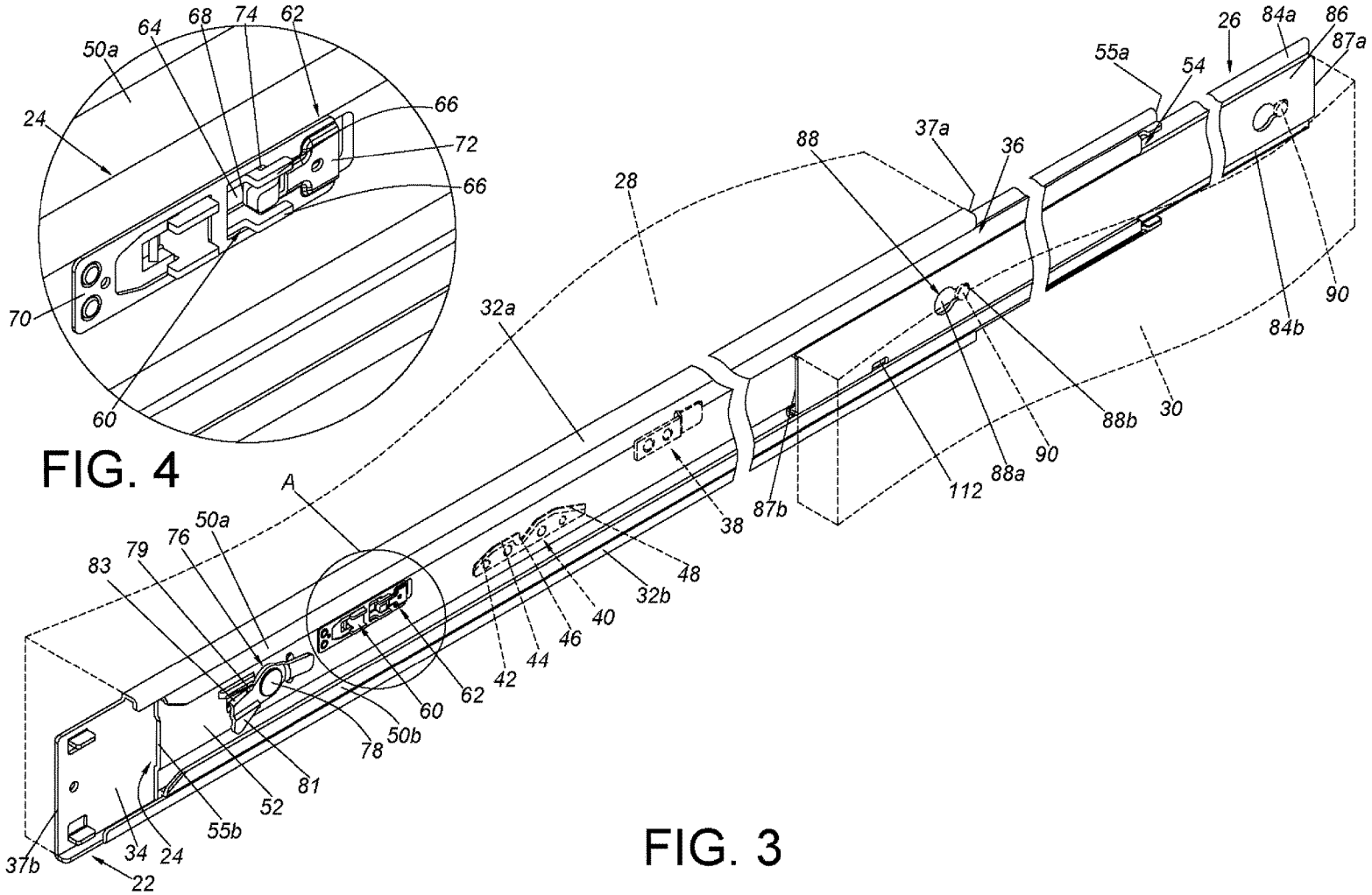
FIG. 3 is a diagram showing the slide rail assembly applicable to the two objects according to an embodiment of the present invention.
FIG. 4 is an enlarged view of an area A of FIG. 3.

As shown in FIG. 2 and FIG. 3, the first rail 22 can be fixed to the first object 28 by riveting, screwing or engaging. In the present embodiment, the first rail 22 is fixed to the first object 28 by a plurality of connecting members 31. The first rail 22 comprises a first wall 32*a*, a second wall 32*b* and a side wall 34 connected between the first wall 32*a* and the second wall 32*b*. A first passage 36 is defined by the first wall 32*a*, the second wall 32*b* and the side wall 34 of the first rail 22. In addition, the first rail 22 has a front part 37*a* and a rear part 37*b*. Moreover, the slide rail assembly 20 further comprises a first blocking feature 38 and a releasing feature 40. In the present embodiment, the first blocking feature 38 is adjacent to the front part 37*a* of the first rail 22, and the releasing feature 40 is adjacent to the rear part 37*b* of the first rail 22. Specifically, the first blocking feature 38 can be an additional component fixed to the side wall 34 of the first rail 22, or can be integrally formed on the side wall 34 of the first rail 22. Therefore, the first blocking feature 38 can be seen as a portion of the first rail 22. In the present invention, the first blocking feature 38 is a protrusion. On the other hand, the releasing feature 40 can be an additional component fixed to the side wall 34 of the first rail 22, or can be integrally formed on the side wall 34 of the first rail 22. Therefore, the releasing feature 40 can be seen as a portion of the first rail 22. The releasing feature 40 and the first blocking feature 38 are spaced from each other. Preferably, the releasing feature 40 comprises a first guiding part 42, a linear part 44, a blocking part 46 and a second guiding part 48. Preferably, each of the first guiding part 42 and the second guiding part 48 has an inclined surface or a curved surface. On the other hand, the linear part 44 and the blocking part 46 are located between the first guiding part 42 and the second guiding part 48. Wherein, a step is formed between the blocking part 46 and the linear part 44.

The second rail 24 is mounted into the first passage 36 of the first rail 22. Specifically, the second rail 24 comprises a first wall 50*a*, a second wall 50*b* and a side wall 52 connected between the first wall 50*a* and the second wall 50*b*. A second passage 54 is defined by the first wall 50*a*, the second wall 50*b* and the side wall 52 of the second rail 24. In addition, the second rail 24 has a front part 55*a* and a rear part 55*b*. Preferably, the second rail 24 comprises a through hole 56 and an aperture 58 facing the first rail 22. Preferably, the slide rail assembly 20 further comprises a second blocking feature 60 and an operating member 62 (please also refer to FIG. 4). Wherein, the second blocking feature 60 can be an additional component arranged on the second rail 24, and the second blocking feature 60 can be operated to move. The second blocking feature 60 passes through the through hole 56. Specifically, the second blocking feature 60 comprises a main body part 64, at least one extension leg 66 and an abutting part 68. For example, the abutting part 68 is located between the main body part 64 and the at least one extension leg 66, and the at least one extension leg 66 is bent relative to the abutting part 68. On the other hand, the operating member 62 is operatively connected to the second rail 24. Preferably, the operating member 62 is configured to be operated to drive the second blocking feature 60 to move. For example, the operating member 62 is an elastic piece. The operating member 62 has a connecting part 70 fixed to the side wall 52 of the second rail 24, and an elastic part 72 connected to the connecting part 70 of the operating member 62. The elastic part 72 has a mounting hole 74 for allowing the extension leg 66 of the second blocking feature 60 to extend therein. The elastic part 72 of the operating member 62 is configured to support the extension leg 66 of the second blocking feature 60. The slide rail assembly 20 further comprises an engaging member 76 mounted to the second rail 24 and adjacent to the rear part 55*b* of the second rail 24. For example, the engaging member 76 is pivoted to the side wall 52 of the second rail 24 by a shaft member 78. The slide rail assembly 20 further comprises an elastic member 79 configured to provide an elastic force to the engaging member 76. The engaging member 76 comprises an extension part 83 and an engaging part 81 adjacent to the extension part 83. The extension part 83 passes through the aperture 58 of the second rail 24. Preferably, the slide rail assembly 20 further comprises at least one third blocking feature 85. For example, the at least one third blocking feature 85 can be a protrusion arranged on the slide wall 52 of the second rail 24 and adjacent to the front part 55*a* of the second rail 24. Wherein, the second blocking feature 60 is located between the at least one third blocking feature 85 and the engaging member 76.

Figure 5:
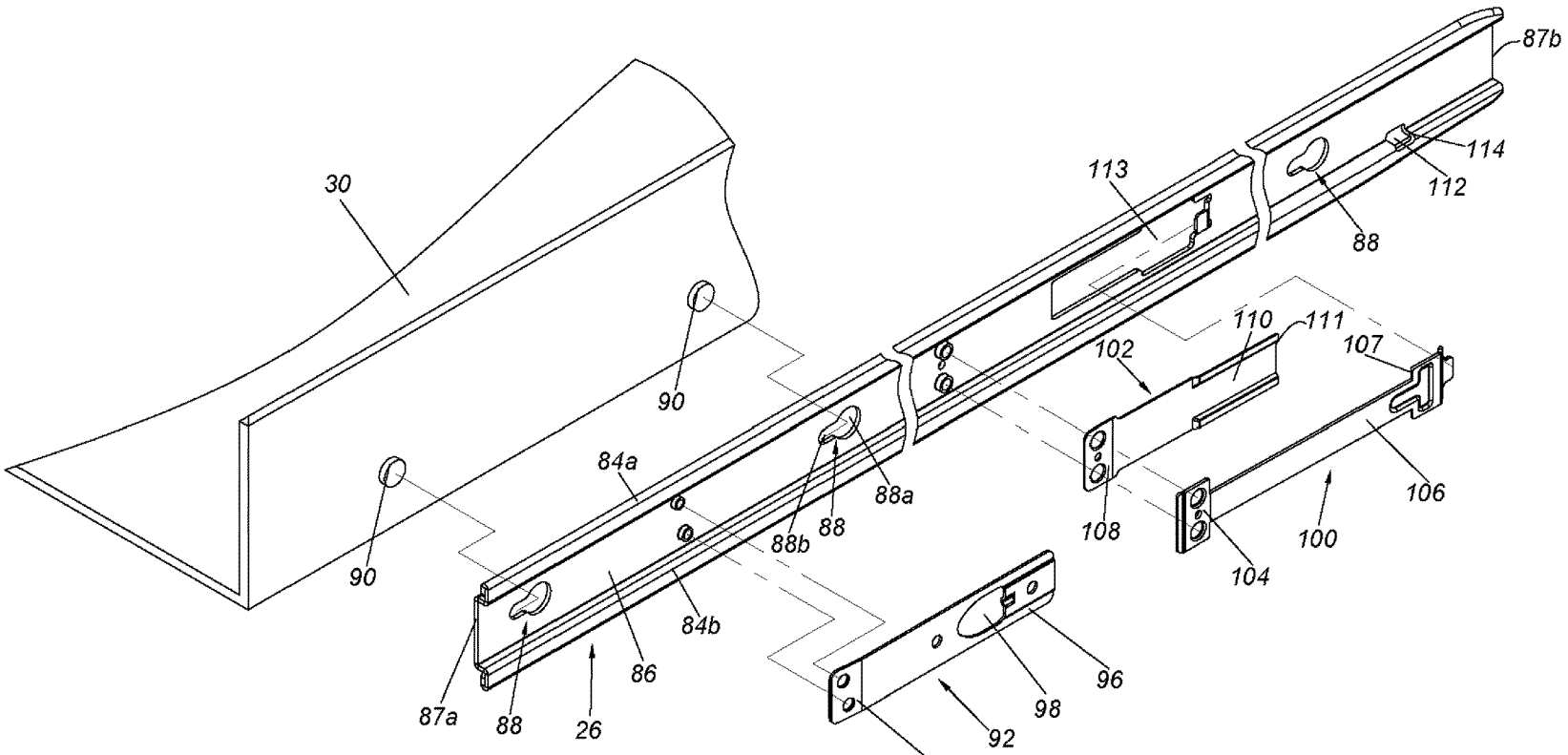
FIG. 5 is an exploded view of a third rail of the slide rail assembly according to an embodiment of the present invention, wherein the third rail is configured to mount a second object.
Figure 6:
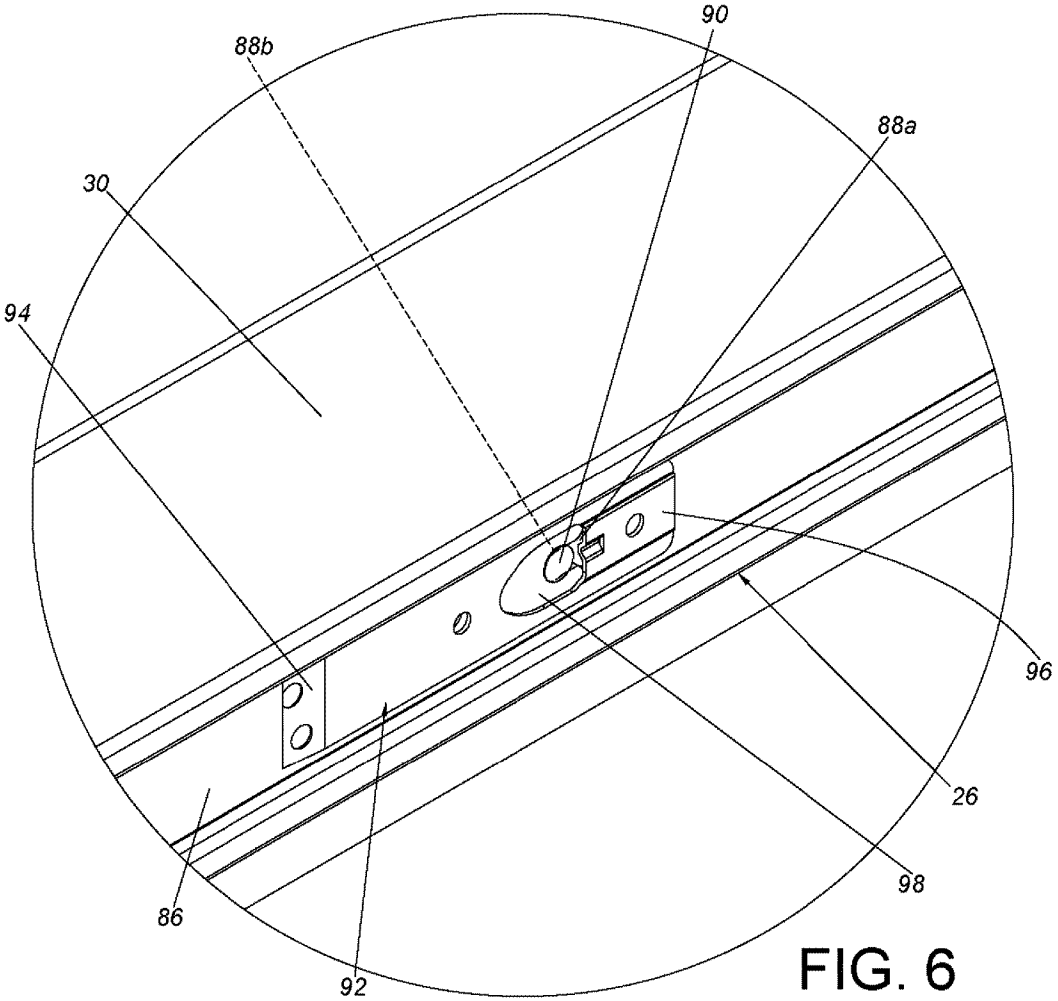
FIG. 6 is a diagram showing a portion of the third rail of the slide rail assembly being configured to mount the second object according to an embodiment of the present invention.

As shown in FIG. 3 and FIG. 5, the third rail 26 is mounted into the second passage 54 of the second rail 24. Specifically, the third rail 26 comprises a first wall 84*a*, a second wall 84*b* and a side wall 86 connected between the first wall 84*a* and the second wall 84*b*. In addition, the third rail 26 has a front part 87*a* and a rear part 87*b*. The third rail 26 is configured to mount the second object 30. For example, the side wall 86 of the third rail 26 has a plurality of mounting holes 88 for mounting a plurality of mounting members 90 of the second object 30. Preferably, the mounting holes 88 are spaced from each other, and each of the mounting holes 88 comprises a first hole part 88*a* and a second hole part 88*b* communicated with the first hole part 88*a*. A diameter of the first hole part 88*a* is greater than a diameter of the second hole part 88*b*. On the other hand, each of the mounting members 90 of the second object 30 is mounted to the corresponding one of the mounting holes 88. For example, each of the mounting members 90 can enter the second hole part 88*b* through the first hole part 88*a*. Preferably, one of the mounting members 90 can be held at the second hole part 88*b* by a holding member 92 (please also refer to FIG. 6). Specifically, the holding member 92 is operatively connected to the third rail 26. For example, the holding member 92 is an elastic piece, and the holding member 92 has a connecting part 94 fixed to the side wall 86 of the third rail 26, an elastic part 96 connected to the connecting part 94 of the holding member 92, and a receiving hole 98 located between the connecting part 94 and the elastic part 96 of the holding member 92. Wherein, the elastic part 96 is located at a position corresponding to the first hole part 88*a*, and the receiving hole 98 is located at a position corresponding to the second hole part 88*b*. Furthermore, as shown in FIG. 5, the slide rail assembly 20 further comprises a fourth blocking feature 100 and a fifth blocking feature 102 arranged on the third rail 26. Preferably, the fourth blocking feature 100 and the fifth blocking feature 102 are operatively connected to the third rail 26. In the present embodiment, both the fourth blocking feature 100 and the fifth blocking feature 102 are elastic pieces, and the fourth blocking feature 100 and the fifth blocking feature 102 are adjacent to the rear part 87*b* of the third rail 26. Specifically, the fourth blocking feature 100 has a connecting part 104 fixed to the side wall 86 of the third rail 26, and an elastic part 106 connected to the connecting part 104 of the fourth blocking feature 100. The elastic part 106 of the fourth blocking feature 100 has a first blocking section 107. On the other hand, the fifth blocking feature 102 has a connecting part 108 fixed to the side wall 86 of the third rail 26, and an elastic part 110 connected to the connecting part 108 of the fifth blocking feature 102. The elastic part 110 of the fifth blocking feature 102 has a second blocking section 111. Wherein, the elastic part 110 of the fifth blocking feature 102 and the elastic part 106 of the fourth blocking feature 100 are configured to support each other. Preferably, the third rail 26 further comprises a receiving port 113 located at a position corresponding to the elastic part 110 of the fifth blocking feature 102 and the elastic part 106 of the fourth blocking feature 100. Preferably, the third rail 26 further comprises an opening 112 and at least one rail wall 114 around the opening 112. The opening 112 is adjacent to the second wall 84*b* of the third rail 26.

Figure 7:
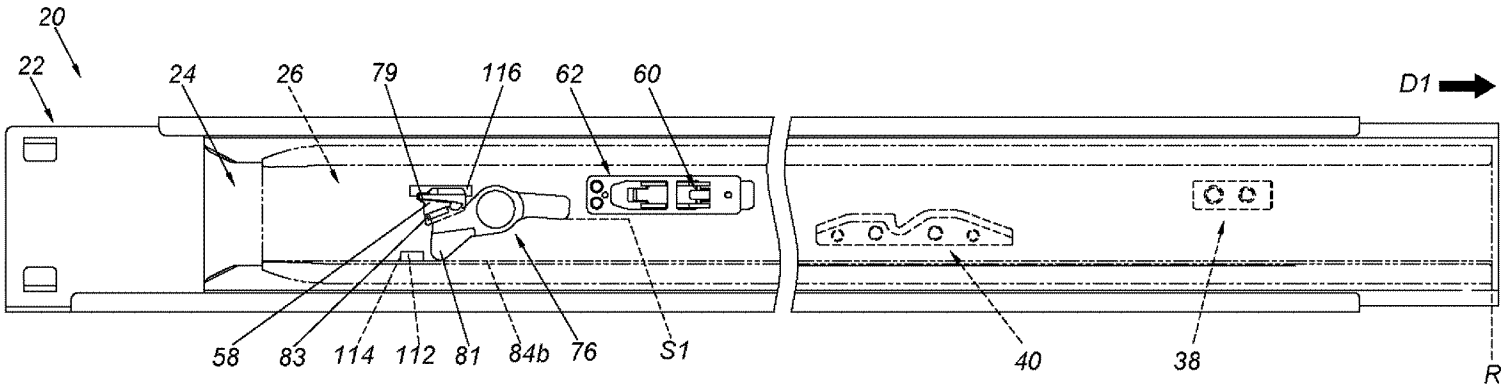
FIG. 7 is a diagram showing the slide rail assembly being in a retracted state according to an embodiment of the present invention.

As shown in FIG. 7, the extension part 83 of the engaging member 76 passes through the aperture 58 of the second rail 24, and the elastic member 79 is located between the engaging member 76 and a supporting wall 116 of the second rail 24, so as to hold the engaging member 76 in a first state S1 relative to the second rail 24. Furthermore, when the slide rail assembly 20 is in a retracted state, the second rail 24 is located at a retracted position relative to the first rail 22. On the other hand, the third rail 24 is also located at a retracted position R relative to the second rail 24. Wherein, the engaging member 76 is driven to abut against one of the first wall 84*a* and the second wall 84*b* of the third rail 26 (such as the second wall 84*b*), and held in the first state S1 by the elastic member 79. Meanwhile, the elastic member 79 accumulates an elastic force.

Figure 8:
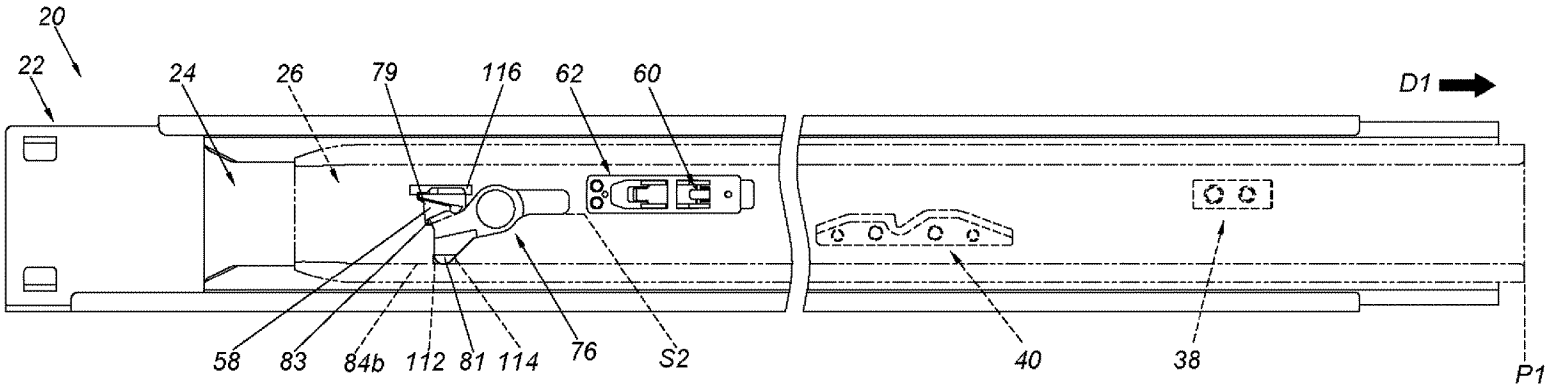
FIG. 8 is a diagram showing the second rail and the third rail of the slide rail assembly being synchronously moved relative to the first rail along a first direction according to an embodiment of the present invention.

As shown in FIG. 8, when the third rail 26 is moved relative to the second rail 24 from the retracted position R to a first predetermined position P1 along a first direction D1 (such as an open direction), the engaging member 76 is configured to engage with the third rail 26, such that the second rail 24 and the third rail 26 can be synchronously moved relative to the first rail 22 along the first direction D1. Specifically, when the third rail 26 is located at the first predetermined position P1 relative to the second rail 24, the engaging member 76 is rotated from the first state S1 to a second state S2 by the elastic force of the elastic member 79. As such, the engaging part 81 of the engaging member 76 enters the opening 112 of the third rail 26 to be located at a position corresponding to the at least one rail wall 114.

Figure 9:
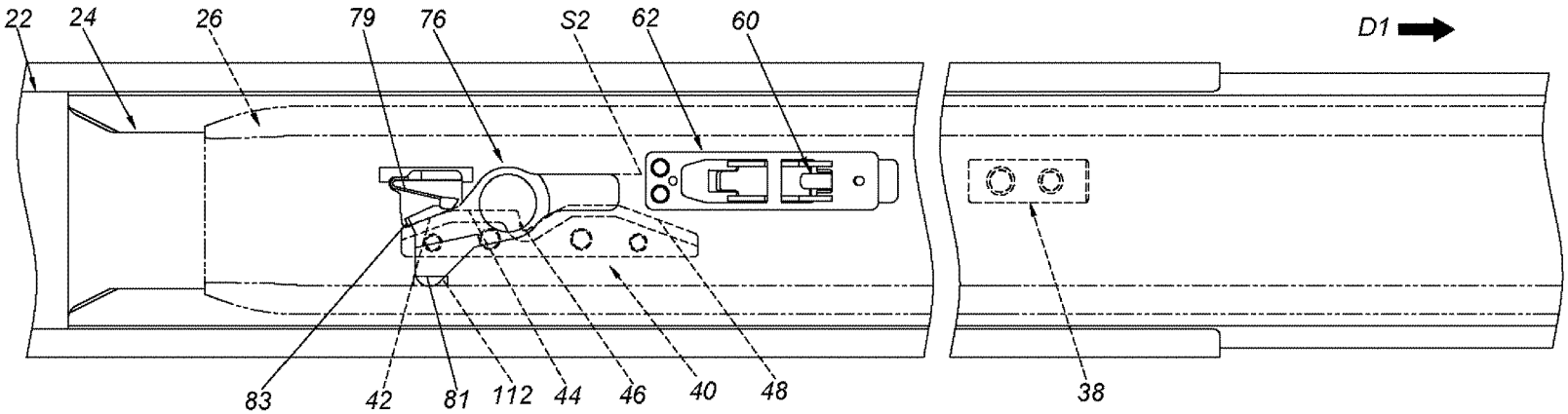
FIG. 9 is a diagram showing the second rail and the third rail of the slide rail assembly being further synchronously moved relative to the first rail along the first direction according to an embodiment of the present invention.
Figure 10:
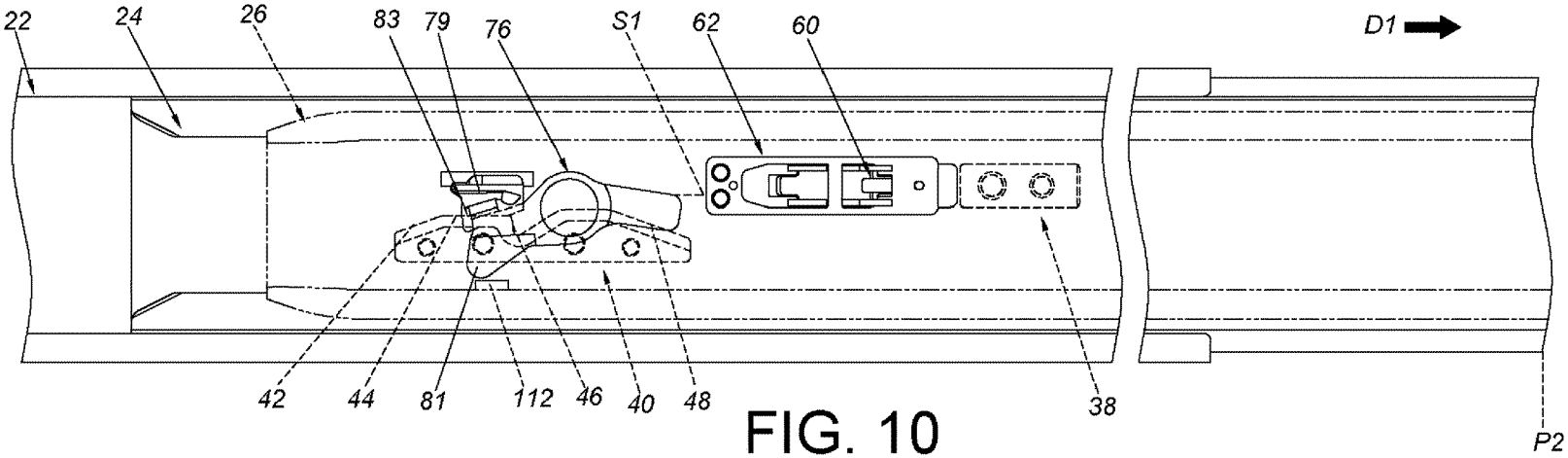
FIG. 10 is a diagram showing the second rail and the third rail of the slide rail assembly being no longer synchronously moved, but individually movable relative to the first rail along the first direction according to an embodiment of the present invention.

As shown in FIG. 9 and FIG. 10, when the engaging member 76 engages with the third rail 26, the second rail 24 is driven by the third rail 26 to synchronously move. That is, the second rail 24 and the third rail 26 can be synchronously moved relative to the first rail 22 along the first direction D1. When the second rail 24 and the third rail 26 are synchronously moved to a second predetermined position P2, the releasing feature 40 of the first rail 22 is configured to disengage the engaging member 76 from the third rail 26. Specifically, during a process of the second rail 24 and the third rail 26 being synchronously moved, the extension part 83 of the engaging member 76 can be moved sequentially along the first guiding part 42, the linear part 44, the blocking part 46 and the second guiding part 48 of the releasing feature 40. For example, when the second rail 24 is moved relative to the first rail 22 to the second predetermined position P2, the engaging member 76 is guided by the first guiding part 42 through the extension part 83 to be no longer in the second state S2 (such as the engaging member 76 returning to the first state S1), such that the engaging part 81 of the engaging member 76 is disengaged from the opening 112 of the third rail 26.

Figure 11:
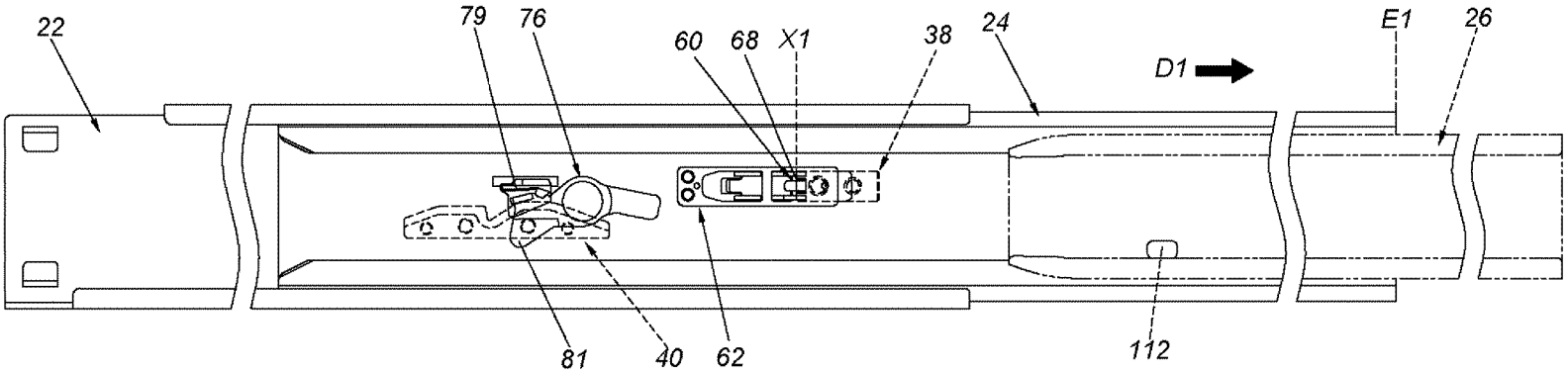
FIG. 11 is a diagram showing the second rail of the slide rail assembly being located at a first open position relative to the first rail with a second blocking feature being blocked by a first blocking feature according to an embodiment of the present invention.

As shown in FIG. 11, after the engaging part 81 of the engaging member 76 is disengaged from the opening 112 of the third rail 26, the second rail 24 is no longer synchronously moved with the third rail 26. The third rail 26 is movable relative to the second rail 24 along the first direction D1.

Figure 12:
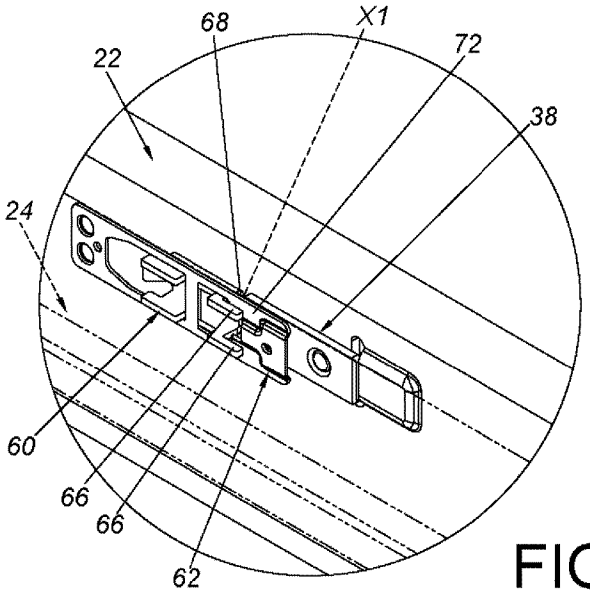
FIG. 12 is a diagram showing the second blocking feature of the slide rail assembly being blocked by the first blocking feature according to an embodiment of the present invention.

As shown in FIG. 11 and FIG. 12, the operating member 62 and the second blocking feature 60 are in a first operating state X1. Wherein, the extension leg 66 of the second blocking feature 60 is arranged on the elastic part 72 of the operating member 62. When the second rail 24 is moved relative to the first rail 22 to a first open position E1 along the first direction D1, the abutting part 68 of the second blocking feature 60 is blocked by the first blocking feature 38 of the first rail 22 in order to prevent the second rail 24 from being moved relative to the first rail 22 from the first open position E1 along the first direction D1.

Figure 13:
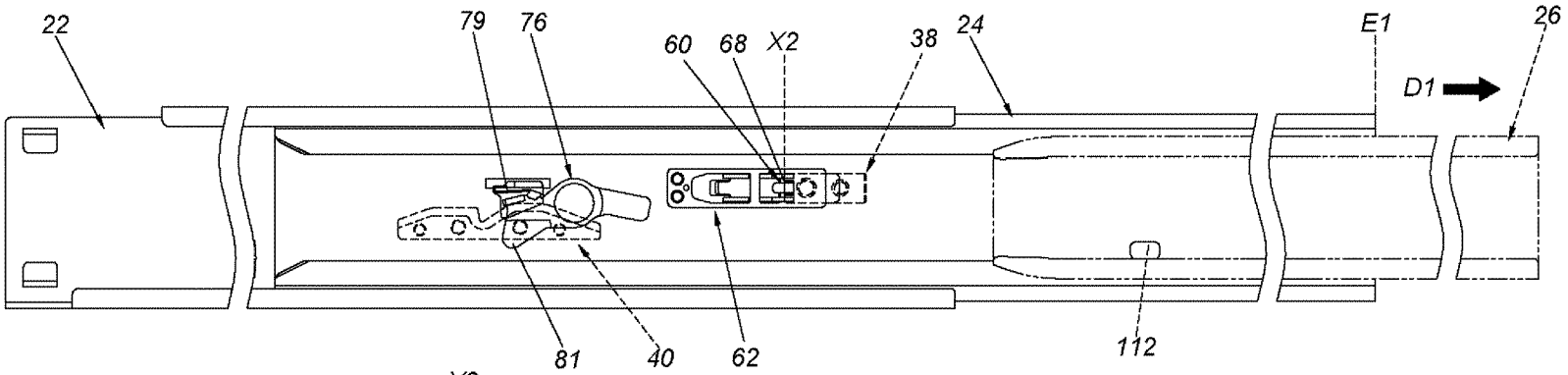
FIG. 13 is a diagram showing the second rail of the slide rail assembly being located at the first open position relative to the first rail with the second blocking feature being no longer blocked by the first blocking feature according to an embodiment of the present invention.
Figure 14:
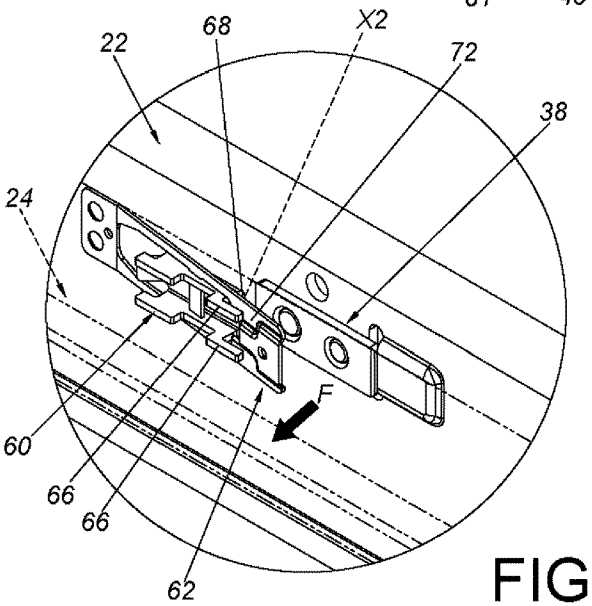
FIG. 14 is a diagram showing the second blocking feature being no longer blocked by the first blocking feature according to an embodiment of the present invention.

As shown in FIG. 13 and FIG. 14, when the abutting part 68 of the second blocking feature 60 of the second rail 24 is blocked by the first blocking feature 38 of the first rail 22, the second blocking feature 60 can be operated to move. For example, a user can apply a force F to the elastic part 72 of the operating member 62, in order to drive the second blocking feature 60 to move from the first operating state X1 to a second operating state X2, such that the abutting part 68 of the second blocking feature 60 is no longer blocked by the first blocking feature 38. In the present embodiment, the second blocking feature 60 is configured to be operated to move away from the first blocking feature 38. However, in an alternative embodiment, the first blocking feature 38 can be operated to move away from the second blocking feature 60 in order to allow the second blocking feature 60 to be no longer blocked by the first blocking feature 38.

Figure 15:
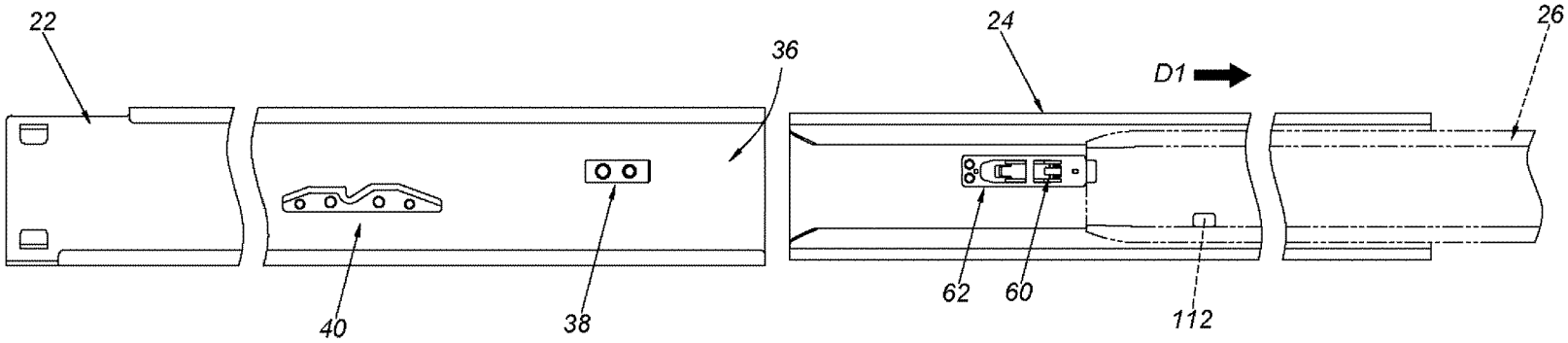
FIG. 15 is a diagram showing the second rail and the third rail of the slide rail assembly being detached from the first rail according to an embodiment of the present invention.

As shown in FIG. 15, when the second blocking feature 60 is no longer blocked by the first blocking feature 38, the second rail 24 can be moved relative to the first rail 22 from the first open position E1 along the first direction D1, in order to be detached from the first passage 36 of the first rail 22.

Figure 16:
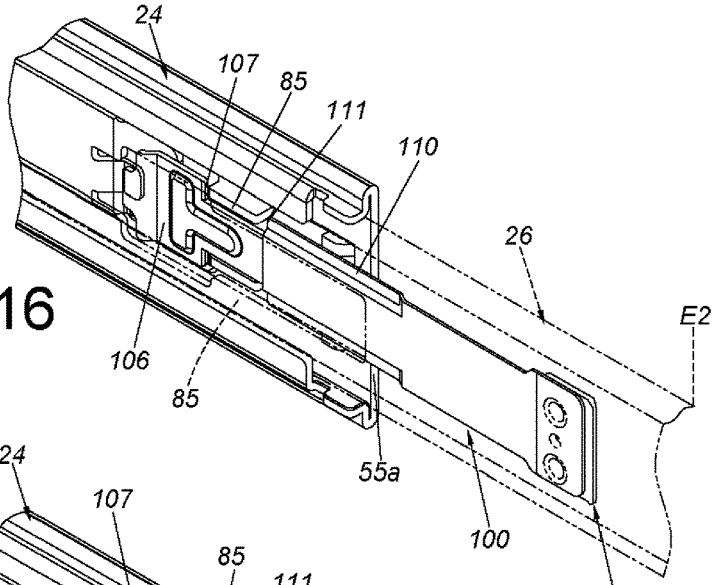
FIG. 16 is a diagram showing the third rail of the slide rail assembly being located at a second open position relative to the second rail with a fourth blocking feature being blocked by a third blocking feature according to an embodiment of the present invention.
Figure 17:
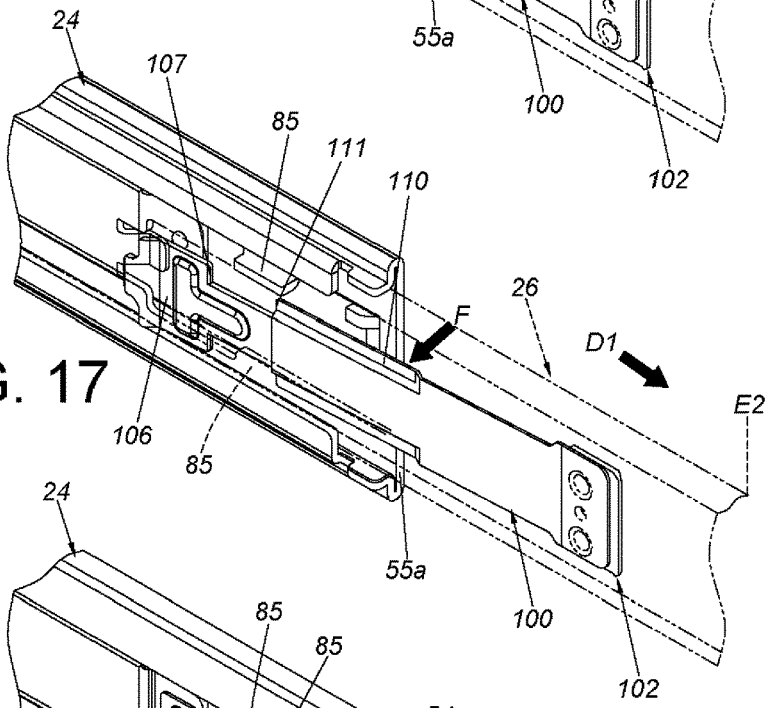
FIG. 17 is a diagram showing the third rail of the slide rail assembly being located at the second open position relative to the second rail with the fourth blocking feature being no longer blocked by the third blocking feature according to an embodiment of the present invention.

As shown in FIG. 16 and FIG. 17, the third rail 26 is movable relative to the second rail 24 along the first direction D1. When the third rail 26 is moved to a second open position E2, the fourth blocking feature 100 is blocked by the at least one third blocking feature 85 in order to prevent the third rail 26 from being moved from the second open position E2 along the first direction D1. Specifically, when the third rail 26 is moved relative to the second rail 24 to the second open position E2, the first blocking section 107 of the elastic part 106 of the fourth blocking feature 100 is blocked by the at least one third blocking feature 85. Preferably, when the third rail 26 is located at the second open position E2 relative to the second rail 24, the first blocking section 107 of the fourth blocking feature 100 and the second blocking section 111 of the fifth blocking feature 102 are respectively located at two opposite sides of the at least one third blocking feature 85. Wherein, the fourth blocking feature 100 can be operated to move away from the at least one third blocking feature 85 to be no longer blocked by the third blocking feature 85. For example, the user can apply a force F to the elastic part 106 of the fourth blocking feature 100 and/or the elastic part 110 of the fifth blocking feature 102, in order to allow the first blocking section 107 of the elastic part 106 of the fourth blocking feature 100 to be no longer blocked by the at least one third blocking feature 85. In the present embodiment, the fourth blocking feature 100 can be operated to move away from the at least one third blocking feature 85. However, in an alternative embodiment, the at least one third blocking feature 85 can be operated to move away from the fourth blocking feature 100 in order to allow the fourth blocking feature 100 to be no longer blocked by the at least one third blocking feature 85.

Figure 18:
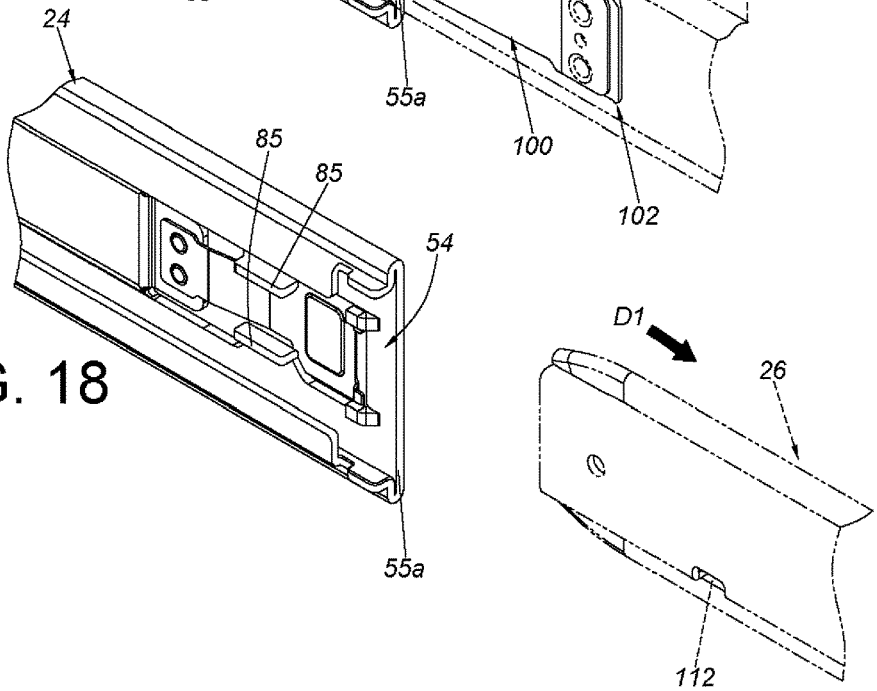
FIG. 18 is a diagram showing the third rail of the slide rail assembly being detached from the second rail according to an embodiment of the present invention.

As shown in FIG. 18, when the fourth blocking feature 100 is no longer blocked by the at least one third blocking feature 85, the third rail 26 can be moved relative to the second rail 24 from the second open position E2 along the first direction D1 to be detached from the second passage 54 of the second rail 24.

Figure 19:
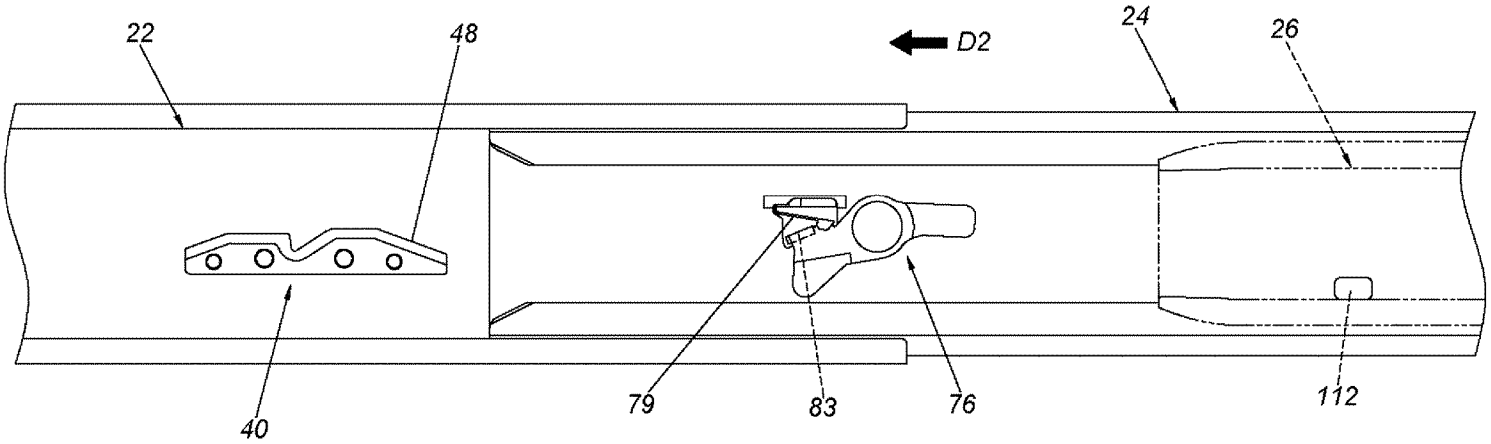
FIG. 19 is a diagram showing the second rail and the third rail of the slide rail assembly being retracted relative to the first rail along a second direction according to an embodiment of the present invention.
Figure 20:
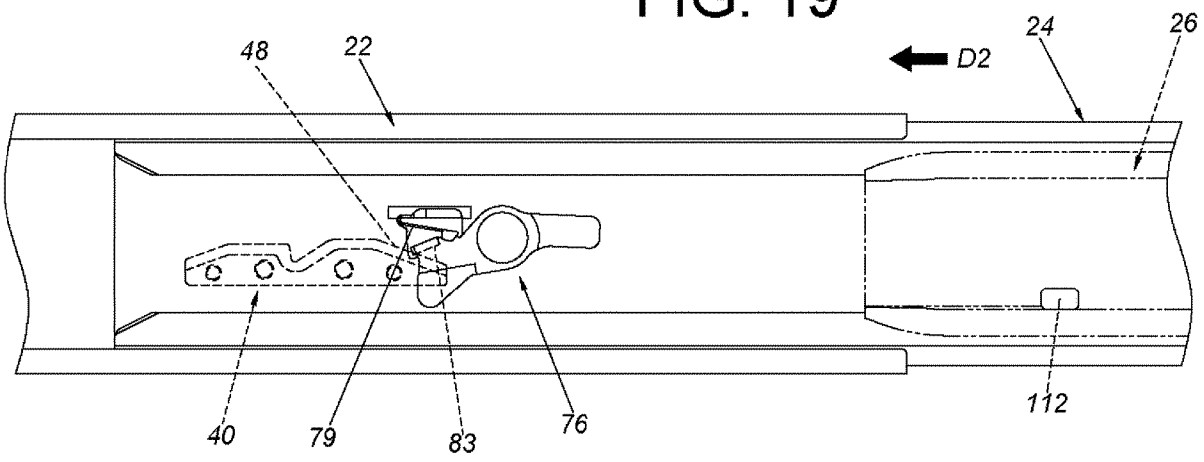
FIG. 20 is a diagram showing the second rail and the third rail of the slide rail assembly being further retracted relative to the first rail along the second direction according to an embodiment of the present invention.

As shown in FIG. 19 and FIG. 20, the second rail 24 and the third rail 26 can be mounted to the first rail 22 again. During a process of the second rail 24 and the third rail 26 being moved relative to the first rail 33 along a second direction D2 (such as a retracted direction), the engaging member 76 is guided by the second guiding part 48 of the releasing feature 40 through the extension part 83 to move along the releasing feature 40.

Figure 21:
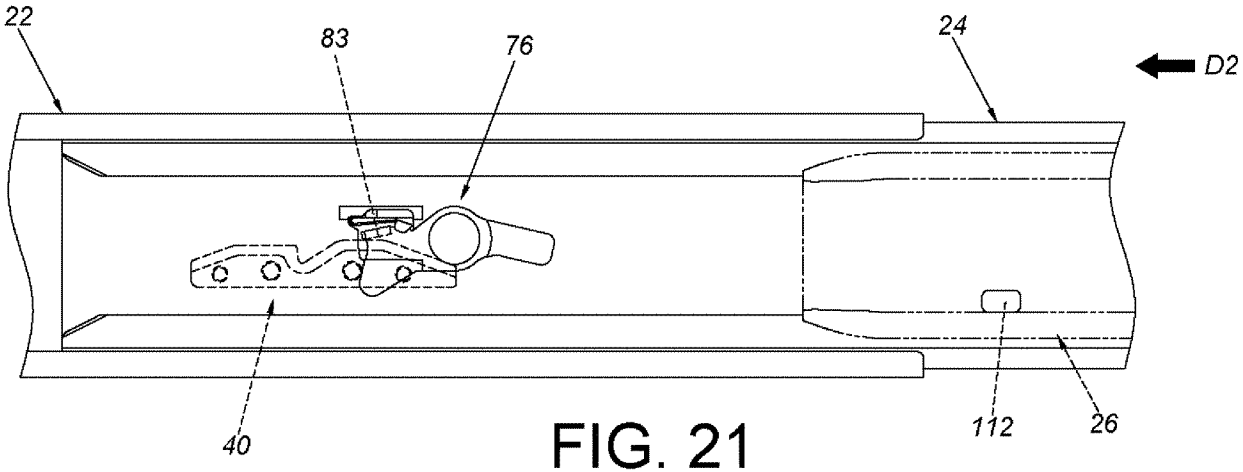
FIG. 21 is a diagram showing the second rail of the slide rail assembly being further retracted relative to the first rail along the second direction according to an embodiment of the present invention.
Figure 22:
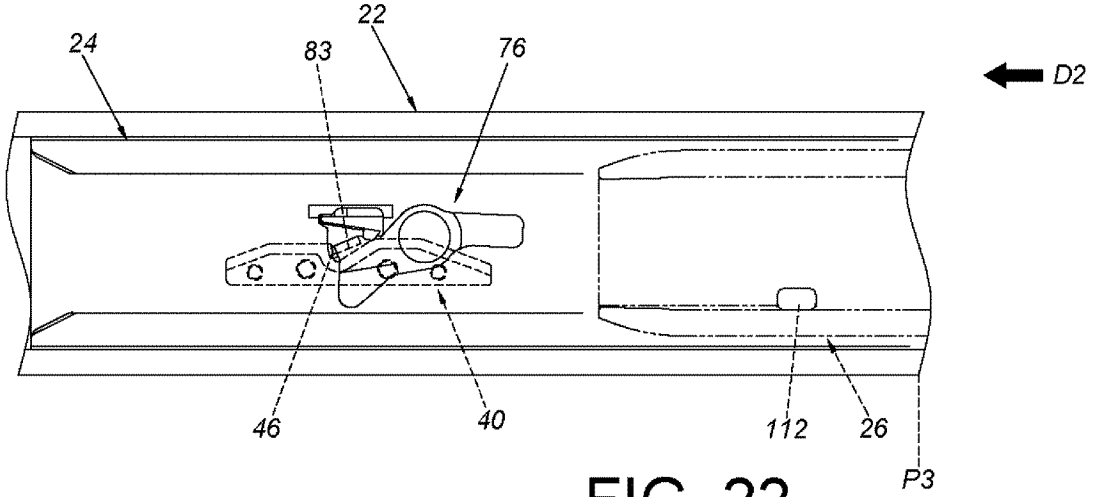
FIG. 22 is a diagram showing the second rail of the slide rail assembly being blocked when the second rail is moved relative to the first rail to a position along the second direction according to an embodiment of the present invention.

As shown in FIG. 21 and FIG. 22, during a process of the second rail 24 being further moved relative to the first rail 22 along the second direction D2, the extension part 83 of the engaging member 76 is further moved along the releasing feature 40. When the second rail 24 is moved to a third predetermined position P3, the extension part 83 of the engaging member 76 can be blocked by the blocking part 46 of the releasing feature 40 in order to prevent the second rail 24 from being moved relative to the first rail 22 along the second direction D2.

Figure 23:
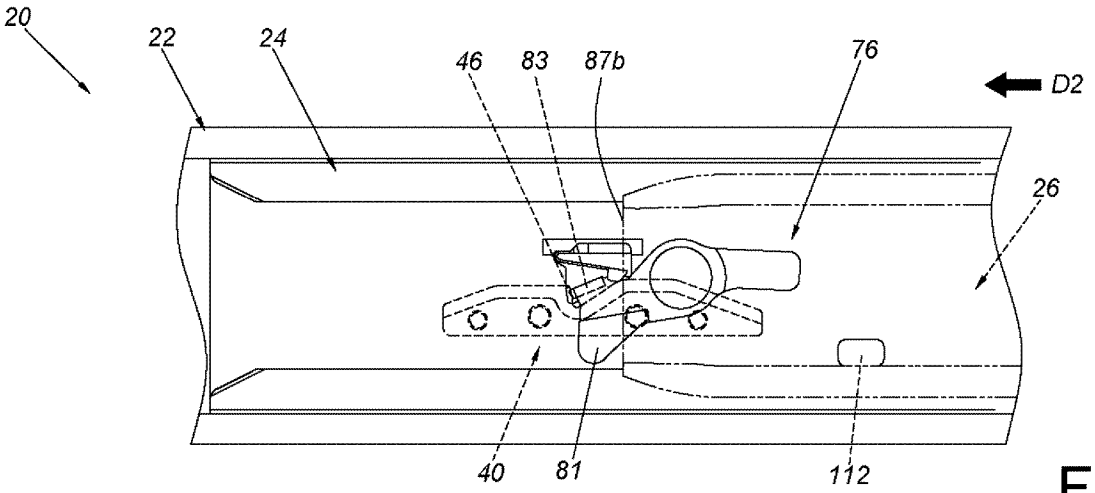
FIG. 23 is a diagram showing the second rail of the slide rail assembly being blocked when the second rail is moved relative to the first rail to the position along the second direction, wherein the third rail is going to disengage the second rail from the first rail according to an embodiment of the present invention.
Figure 24:
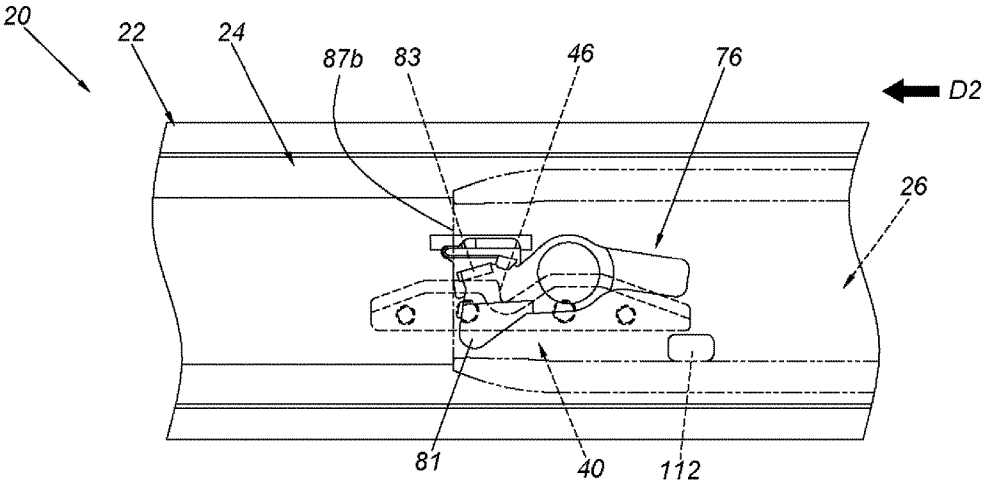
FIG. 24 is a diagram showing the second rail and the third rail of the slide rail assembly being further retracted relative to the first rail along the second direction according to an embodiment of the present invention.

As shown in FIG. 23 and FIG. 24, the extension part 83 of the engaging member 76 is blocked by the blocking part 46 of the releasing feature 40. During a process of the third rail 26 being moved relative to the second rail 24 along the second direction D2, the rear part 87*b* of the third rail 26 abuts against the engaging part 81 for rotating the engaging member 76, such that the extension part 83 of the engaging member 76 is no longer blocked by the blocking part 46 of the releasing feature 40. In other words, the second rail 24 is movable relative to the first rail 22 along the second direction D2. Therefore, both the second rail 24 and the third rail 26 can be retracted relative to the first rail 22 along the second direction D2.

Therefore, the slide rail assembly of the present invention is characterized in that:

1. The second rail 24 and the third rail 26 can be detached from or mounted to the first rail 22, so as to assist the user in maintaining the slide rail and/or the object.

2. The third rail 26 can be detached from or mounted to the second rail 24, so as to assist the user in maintaining the slide rail and/or the object.

3. The second rail 24 and the third rail 26 can be synchronously moved a predetermined moving distance relative to the first rail 22 along the first direction D1. According to such arrangement, when the third rail 26 carries an object, the second rail 24 and the third rail 26 can share weight of the object in order to increase supporting strength.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A slide rail assembly, comprising:

a first rail arranged with a first blocking feature;

a second rail arranged with a second blocking feature and movable relative to the first rail; and a third rail movable relative to the second rail;

wherein the second rail is movably mounted between the first rail and the third rail;

wherein when the second rail is moved relative to the first rail along a first direction to a first open position, the second blocking feature is blocked by the first blocking feature in order to prevent the second rail from being moved from the first open position along the first direction;

wherein one of the first blocking feature and the second blocking feature is configured to be operated to move away from each other with the second blocking feature being no longer blocked by the first blocking feature, in order to allow the second rail to be moved from the first open position along the first direction to be further detached from the first rail;

wherein, the slide rail assembly further comprises a third blocking feature and a fourth blocking feature respectively arranged on the second rail and the third rail, when the third rail is moved relative to the second rail along the first direction to a second open position, the fourth blocking feature is blocked by the third blocking feature in order to prevent the third rail from being moved from the second open position along the first direction;

wherein, the slide rail assembly further comprises a fifth blocking feature operatively connected to the third rail, wherein when the third rail is located at the second open position relative to the second rail, the fourth blocking feature and the fifth blocking feature are respectively located at two opposite sides of the third blocking feature.

2. The slide rail assembly of claim 1, further comprising an operating member configured to be operated to drive the second blocking feature to move.

3. The slide rail assembly of claim 2, wherein the second rail comprises a through hole facing the first rail, and the second blocking feature passes through the through hole.

4. The slide rail assembly of claim 1, wherein one of the third blocking feature and the fourth blocking feature is configured to be operated to move away from each other with the fourth blocking feature being no longer blocked by the third blocking feature, in order to allow the third rail to be moved from the second open position along the first direction to be further detached from the second rail.

5. The slide rail assembly of claim 4, wherein the fourth blocking feature is operatively connected to the third rail.

6. The slide rail assembly of claim 1, further comprising an engaging member mounted to the second rail, wherein when the third rail is moved relative to the second rail along the first direction from a retracted position to a first predetermined position, the engaging member is configured to engage with the third rail in order to allow the second rail and the third rail to be synchronously moved relative to the first rail along the first direction.

7. The slide rail assembly of claim 6, wherein the first rail comprises a releasing feature, wherein when the second rail and the third rail are synchronously moved relative to the first rail along the first direction to a second predetermined position, the releasing feature is configured to disengage the engaging member from the third rail, in order to allow the third rail to be moved relative to the second rail along the first direction.

8. The slide rail assembly of claim 7, wherein the engaging member is pivoted to the second rail, the slide rail assembly further comprises an elastic member configured to provide an elastic force to the engaging member, the third rail comprises a first wall, a second wall and a side wall connected between the first wall and the second wall; when the third rail is located at the retracted position relative to the second rail, the engaging member is driven to abut against the first wall and held in a first state by the elastic force of the elastic member.

9. The slide rail assembly of claim 8, wherein the third rail has an opening and a rail wall adjacent to the opening, the engaging member comprises an engaging part; when the third rail is located at the first predetermined position relative to the second rail, the engaging member is rotated relative to the second rail from the first state to a second state in response to the elastic force of the elastic member, such that the engaging part enters the opening to be located at a position corresponding to the rail wall.

10. The slide rail assembly of claim 7, wherein the second rail comprises an aperture facing the first rail, the engaging member comprises an extension part passing through the aperture, the releasing feature comprises a first guiding part; during a process of the second rail and the third rail being synchronously moved to the second predetermined position along the first direction, the extension part of the engaging member is guided by the first guiding part to disengage the engaging member from the third rail.

11. The slide rail assembly of claim 10, wherein the releasing feature further comprises a blocking part, when the second rail is moved relative to the first rail from the first open position to a third predetermined position along a second direction opposite to the first direction, the extension part of the engaging member is blocked by the blocking part for preventing the second rail from being moved relative to the first rail along the second direction.

12. The slide rail assembly of claim 11, wherein the releasing feature further comprises a second guiding part, during a process of the second rail being moved relative to the first rail from the first open position to the third predetermined position along the second direction, the engaging member is guided by the second guiding part through the extension part.

13. The slide rail assembly of claim 12, wherein the releasing feature further comprises a linear part, the blocking part and the linear part are located between the first guiding part and the second guiding part.

14. The slide rail assembly of claim 11, wherein during a process of the third rail being moved relative to the second rail along the second direction, the engaging member is driven by the third rail to move, such that the extension part of the engaging member is no longer blocked by the blocking part.

15. A slide rail assembly, comprising:

a first rail arranged with a first blocking feature;

a second rail arranged with a second blocking feature and movable relative to the first rail; and a third rail movable relative to the second rail;

wherein the second rail is movably mounted between the first rail and the third rail;

wherein when the second rail is moved relative to the first rail along a first direction to a first open position, the second blocking feature is blocked by the first blocking feature in order to prevent the second rail from being moved from the first open position along the first direction;

wherein one of the first blocking feature and the second blocking feature is configured to be operated to move away from each other with the second blocking feature being no longer blocked by the first blocking feature, in order to allow the second rail to be moved from the first open position along the first direction to be further detached from the first rail;

wherein the slide rail assembly further comprises an engaging member mounted to the second rail, wherein when the third rail is moved relative to the second rail along the first direction from a retracted position to a first predetermined position, the engaging member is configured to engage with the third rail in order to allow the second rail and the third rail to be synchronously moved relative to the first rail along the first direction;

wherein the first rail comprises a releasing feature, wherein when the second rail and the third rail are synchronously moved relative to the first rail along the first direction to a second predetermined position, the releasing feature is configured to disengage the engaging member from the third rail, in order to allow the third rail to be moved relative to the second rail along the first direction;

wherein the engaging member is pivoted to the second rail, the slide rail assembly further comprises an elastic member configured to provide an elastic force to the engaging member, the third rail comprises a first wall, a second wall and a side wall connected between the first wall and the second wall; when the third rail is located at the retracted position relative to the second rail, the engaging member is driven to abut against the first wall and held in a first state by the elastic force of the elastic member.

16. A slide rail assembly, comprising:

a first rail arranged with a first blocking feature;

a second rail arranged with a second blocking feature and movable relative to the first rail; and a third rail movable relative to the second rail;

wherein the second rail is movably mounted between the first rail and the third rail;

wherein when the second rail is moved relative to the first rail along a first direction to a first open position, the second blocking feature is blocked by the first blocking feature in order to prevent the second rail from being moved from the first open position along the first direction;

wherein one of the first blocking feature and the second blocking feature is configured to be operated to move away from each other with the second blocking feature being no longer blocked by the first blocking feature, in order to allow the second rail to be moved from the first open position along the first direction to be further detached from the first rail;

wherein the slide rail assembly further comprises an engaging member mounted to the second rail, wherein when the third rail is moved relative to the second rail along the first direction from a retracted position to a first predetermined position, the engaging member is configured to engage with the third rail in order to allow the second rail and the third rail to be synchronously moved relative to the first rail along the first direction;

wherein the first rail comprises a releasing feature, wherein when the second rail and the third rail are synchronously moved relative to the first rail along the first direction to a second predetermined position, the releasing feature is configured to disengage the engaging member from the third rail, in order to allow the third rail to be moved relative to the second rail along the first direction;

wherein the second rail comprises an aperture facing the first rail, the engaging member comprises an extension part passing through the aperture, the releasing feature comprises a first guiding part; during a process of the second rail and the third rail being synchronously moved to the second predetermined position along the first direction, the extension part of the engaging member is guided by the first guiding part to disengage the engaging member from the third rail;

wherein the releasing feature further comprises a blocking part, when the second rail is moved relative to the first rail from the first open position to a third predetermined position along a second direction opposite to the first direction, the extension part of the engaging member is blocked by the blocking part for preventing the second rail from being moved relative to the first rail along the second direction.

17. A slide rail assembly, comprising:

a first rail arranged with a first blocking feature;

a second rail arranged with a second blocking feature and movable relative to the first rail; and a third rail movable relative to the second rail;

wherein the second rail is movably mounted between the first rail and the third rail;

wherein when the second rail is moved relative to the first rail along a first direction to a first open position, the second blocking feature is blocked by the first blocking feature in order to prevent the second rail from being moved from the first open position along the first direction;

wherein one of the first blocking feature and the second blocking feature is configured to be operated to move away from each other with the second blocking feature being no longer blocked by the first blocking feature, in order to allow the second rail to be moved from the first open position along the first direction to be further detached from the first rail;

wherein the slide rail assembly further comprises an engaging member mounted to the second rail, wherein when the third rail is moved relative to the second rail along the first direction from a retracted position to a first predetermined position, the engaging member is configured to engage with the third rail in order to allow the second rail and the third rail to be synchronously moved relative to the first rail along the first direction;

wherein the first rail comprises a releasing feature, wherein when the second rail and the third rail are synchronously moved relative to the first rail along the first direction to a second predetermined position, the releasing feature is configured to disengage the engaging member from the third rail, in order to allow the third rail to be moved relative to the second rail along the first direction;

wherein the second rail comprises an aperture facing the first rail, the engaging member comprises an extension part passing through the aperture, the releasing feature comprises a first guiding part; during a process of the second rail and the third rail being synchronously moved to the second predetermined position along the first direction, the extension part of the engaging member is guided by the first guiding part to disengage the engaging member from the third rail;

wherein the releasing feature further comprises a blocking part, when the second rail is moved relative to the first rail from the first open position to a third predetermined position along a second direction opposite to the first direction, the extension part of the engaging member is blocked by the blocking part for preventing the second rail from being moved relative to the first rail along the second direction;

wherein during a process of the third rail being moved relative to the second rail along the second direction, the engaging member is driven by the third rail to move, such that the extension part of the engaging member is no longer blocked by the blocking part.

* * * * *